US006349484B1

(12) United States Patent
Cohen

(10) Patent No.: US 6,349,484 B1
(45) Date of Patent: Feb. 26, 2002

(54) BODY DRYER WITH MIRROR

(76) Inventor: Sol Cohen, 4045 Bedford Ave., Brooklyn, NY (US) 11229

( * ) Notice: Subject to any disclaimer, the term of this patent is extended or adjusted under 35 U.S.C. 154(b) by 0 days.

(21) Appl. No.: 09/502,309

(22) Filed: Feb. 11, 2000

(51) Int. Cl.[7] ..... F26B 19/00; F26B 3/02

(52) U.S. Cl. ..... 34/90; 34/225; 34/233; 392/381

(58) Field of Search ..... 34/90, 91, 233, 34/225, 97, 98; 392/363, 370, 380, 381

(56) References Cited

U.S. PATENT DOCUMENTS 3,878,621 A 4/1975 Duerre
4,195,416 A * 4/1980 Hall ..... 34/90
4,227,068 A * 10/1980 Carter ..... 219/366
4,621,439 A 11/1986 Maw-Chyi
4,685,222 A 8/1987 Houch, Jr.
4,701,594 A * 10/1987 Powell ..... 219/219
4,780,595 A 10/1988 Alban
D311,070 S 10/1990 Blevins
4,961,272 A * 10/1990 Lee ..... 34/90
5,103,577 A * 4/1992 Michaels ..... 34/91
5,269,071 A * 12/1993 Hamabe et al. ..... 34/48
5,377,424 A 1/1995 Albanes
5,438,763 A * 8/1995 Yang ..... 34/90
5,873,179 A * 2/1999 Gregory et al. ..... 34/90

* cited by examiner

*Primary Examiner*—Denise L. Esquivel
*Assistant Examiner*—Greg T. Warder

(57) ABSTRACT

A body dryer is provided including a housing having an elongated height. Also included is a mirror mounted on the housing. A heating mechanism is situated along the height of the housing for expelling heated air therefrom.

1 Claim, 2 Drawing Sheets

FIG 3
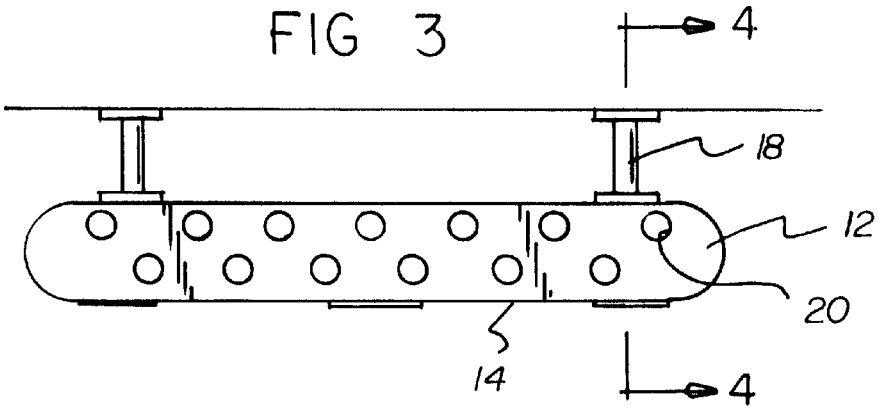
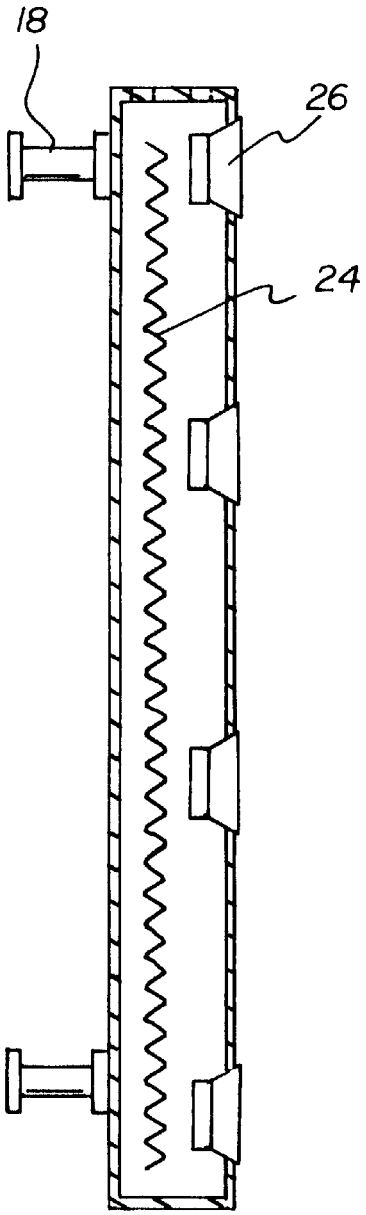
FIG 4

BODY DRYER WITH MIRROR

BACKGROUND OF THE INVENTION

1. Field of the Invention

The present invention relates to body dryers and more particularly pertains to a new body dryer with mirror for drying a body of a user while viewing the same.

2. Description of the Prior Art

The use of body dryers is known in the prior art. More specifically, body dryers heretofore devised and utilized are known to consist basically of familiar, expected and obvious structural configurations, notwithstanding the myriad of designs encompassed by the crowded prior art which have been developed for the fulfillment of countless objectives and requirements.

Known prior art body dryers include U. S. Pat. No. 3,878,621; U.S. Pat. No. 5,377,424; U.S. Pat. No. 4,780,595; U.S. Pat. No. 4,685,222; U.S. Pat. No. 4,621,439; and U.S. Pat. Des. 311,070.

In these respects, the body dryer with mirror according to the present invention substantially departs from the conventional concepts and designs of the prior art, and in so doing provides an apparatus primarily developed for the purpose of drying a body of a user while viewing the same.

SUMMARY OF THE INVENTION

In view of the foregoing disadvantages inherent in the known types of body dryers now present in the prior art, the present invention provides a new body dryer with mirror construction wherein the same can be utilized for drying a body of a user while viewing the same.

The general purpose of the present invention, which will be described subsequently in greater detail, is to provide a new body dryer with mirror apparatus and method which has many of the advantages of the body dryers mentioned heretofore and many novel features that result in a new body dryer with mirror which is not anticipated, rendered obvious, suggested, or even implied by any of the prior art body dryers, either alone or in any combination thereof.

To attain this, the present invention generally comprises a housing having an enlarged rectangular front face, an enlarged rectangular rear face, and a periphery formed therebetween for defining an interior space. As shown in the Figures, the periphery is defined by a top face, a bottom face, and a pair of arcuate side faces. The front face is equipped with a rectangular recess formed therein. The recess has a planar rectangular recessed face and a pair of angled recessed sides. The rear face has a plurality of cylindrical mounts coupled thereto and extending rearwardly therefrom. The mounts serve for being coupled to a vertical recipient surface such that the housing remains in spaced parallel relationship with the recipient surface. As shown in FIG. 3, the top face has a pair of staggered rows of linearly aligned circular breathing apertures formed therein. Next provided is an enlarged planar rectangular mirror mounted on the recessed face of the housing. An elongated fluorescent light is mounted on each of the angled recessed sides of the recess of the housing for illuminating upon the receipt of power. A plurality of vertically oriented heating coils are situated within the interior space of the housing adjacent to the side faces of the periphery thereof. In use, the heating coils are adapted to generate heat within the interior space of the housing upon the receipt of power. Associated therewith is a plurality of blower assemblies each having a circular configuration. The blower assemblies are mounted on the front face of the housing between the recess and the periphery thereof. In use, the blower assemblies function to blow heated air from the interior space of the housing in a direction perpendicular with respect to the front face of the housing. This is effected only upon the receipt of power by the blower assemblies. As shown in FIGS. 1 & 2, a power switch is mounted on a middle extent of the front face of the housing adjacent to one of the side faces of the periphery thereof. The power switch is connected between the fluorescent light, heating coils, blower assemblies and a power source for selectively supplying the same with power.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new body dryer with mirror apparatus and method which has many of the advantages of the body dryers mentioned heretofore and many novel features that result in a new body dryer with mirror which is not anticipated, rendered obvious, suggested, or even implied by any of the prior art body dryers, either alone or in any combination thereof.

It is another object of the present invention to provide a new body dryer with mirror which may be easily and efficiently manufactured and marketed.

It is a further object of the present invention to provide a new body dryer with mirror which is of a durable and reliable construction.

An even further object of the present invention is to provide a new body dryer with mirror which is susceptible of a low cost of manufacture with regard to both materials and labor, and which accordingly is then susceptible of low prices of sale to the consuming public, thereby making such body dryer with mirror economically available to the buying public.

Still yet another object of the present invention is to provide a new body dryer with mirror which provides in the apparatuses and methods of the prior art some of the advantages thereof, while simultaneously overcoming some of the disadvantages normally associated therewith.

Still another object of the present invention is to provide a new body dryer with mirror for drying a body of a user while viewing the same.

Even still another object of the present invention is to provide a new body dryer with mirror that includes a sing having an elongated height. Also included is a mirror mounted on the housing. A heating mechanism is situated along the height of the housing for expelling heated air therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top view of the present invention.

FIG. 4 is a cross-sectional view of the present invention taken along line 4—4 shown in FIG. 3.

DESCRIPTION OF THE PREFERRED EMBODIMENT

Figure 1:
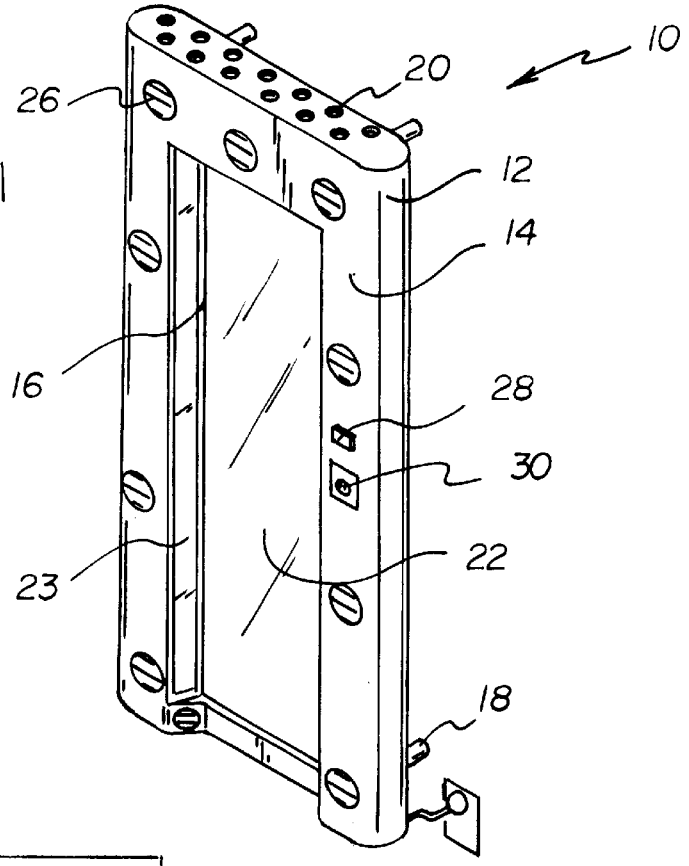
FIG. 1 is a perspective view of a new body dryer with mirror according to the present invention.

With reference now to the drawings, and in particular to FIGS. 1 through 4 thereof, a new body dryer with mirror embodying the principles and concepts of the present invention and generally designated by the reference numeral 10 will be described.

Figure 2:
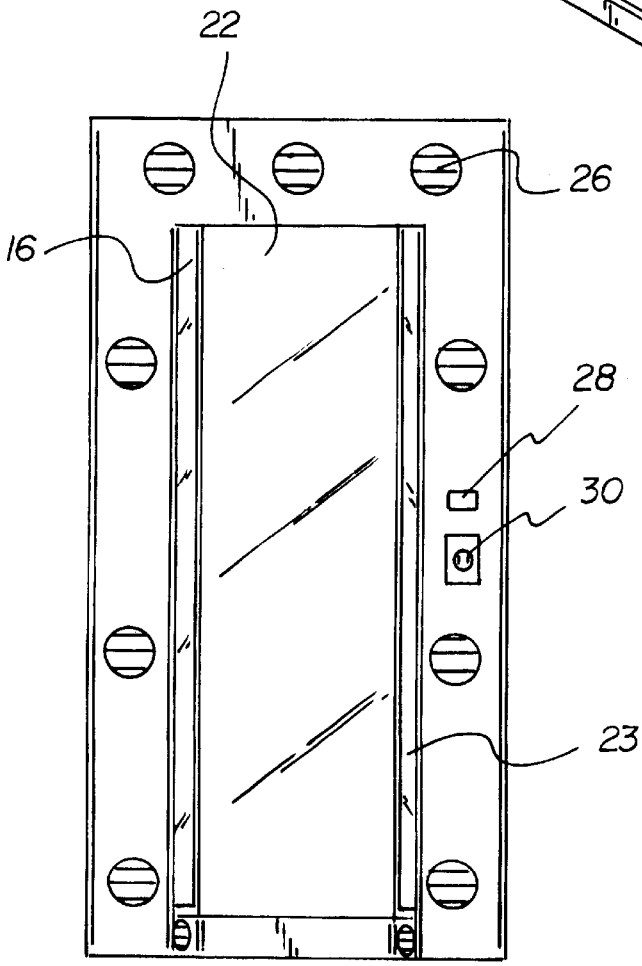
FIG. 2 is a front view of the present invention.

The present invention, designated as numeral 10, includes a housing 12 having an enlarged rectangular front face 14, an enlarged rectangular rear face, and a thin periphery formed therebetween for defining an interior space. As shown in the Figures, the periphery is defined by a top face, a bottom face, and a pair of arcuate side faces. Ideally, the housing has a height which is about 3 times a width thereof. The front face is equipped with a rectangular recess 16. As shown in FIG. 2, the recess has a height approximately equal to that of the housing and a width equal to about ½ that of the housing. The recess is defined by a planar rectangular recessed face and a pair of angled recessed sides.

The rear face of the housing has a plurality of cylindrical mounts 18 coupled thereto and extending rearwardly therefrom. The mounts serve for being coupled to a vertical recipient surface such that the housing remains in spaced parallel relationship with the recipient surface. As shown in FIG. 3, the top face has a pair of staggered rows of linearly aligned circular breathing apertures 20 formed therein for reasons that will soon become apparent.

Next provided is an enlarged planar rectangular mirror 22 mounted on the recessed face of the housing. An elongated fluorescent light 23 is mounted on each of the angled recessed sides of the recess of the housing along an entire height thereof. The light is adapted for illuminating upon the receipt of power.

A plurality of heating coils 24 are situated within the interior space of the housing adjacent to the side faces and top face of its periphery. In use, the heating coils are adapted to generate heat within the interior space of the housing upon the receipt of power.

Associated therewith is a plurality of blower assemblies 26 each having a circular configuration. The blower assemblies are mounted on the front face of the housing between the recess and the periphery thereof. As shown in FIG. 1, the blower assemblies are configured in a pair of side columns and a top row. In addition, a pair of lower blowers are mounted on the angled recessed side of the recess. In use, the blower assemblies function to blow heated air from the interior space of the housing in a direction perpendicular with respect to the front face of the housing. The lower blowers, however, blow air along paths which intersect in front of the mirror. This, of course, is effected only upon the receipt of power by the blower assemblies.

As shown in FIGS. 1 & 2, a power switch 28 is mounted on a middle extent of the front face of the housing adjacent to one of the side faces of the periphery thereof. The power switch is connected between the fluorescent lights, heating coils, blower assemblies and a power source for selectively supplying the same with power. As shown in FIG. 1, a cord extends from the rear face of the housing for such purpose. In the preferred embodiment, a power receptacle 30 is mounted on the front face of the housing and is connected directly to the power source. The power receptacle functions to allow the use of a hand-held blow dryer during operation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A body dryer comprising, in combination:

a housing having an enlarged rectangular front face, an enlarged rectangular rear face, and a periphery formed therebetween for defining an interior space, the periphery defined by a top face, a bottom face, and a pair of arcuate side faces, the front face having a rectangular recess formed therein thereby defining a planar rectangular recessed face and a pair of angled recessed sides, the rear face having a plurality of mounts, each of said plurality of mounts having a length coupled thereto, said mounts having a length, and extending rearwardly from said rear face for being coupled to a vertical recipient surface such that the housing remains in spaced parallel relationship) with the recipient surface, wherein there is an opening between said rear face and said vertical recipient surface, the top face having a pair of staggered rows of linearly aligned circular breathing apertures formed therein;

an enlarged planar rectangular mirror mounted on the recessed face of the housing;

an elongated fluorescent light mounted on each of the angled recessed sides of the recess of the housing for illuminating upon the receipt of power;

a plurality of vertically oriented heating coils situated within the interior space of the housing adjacent to the side faces of the periphery thereof, the heating coils adapted to generate heat within the interior space of the housing upon the receipt of power;

a plurality of blower assemblies each having a circular configuration, the blower assemblies mounted on the front face of the housing between the recess and the periphery thereof, wherein the blower assemblies are adapted to blow heated air from the interior space of the housing in a direction perpendicular with respect to the front face of the housing only upon the receipt of power; and a power switch mounted on a middle extent of the front face of the housing adjacent to one of the side faces of the periphery thereof, the power switch connected between the fluorescent light, heating coils, blower assemblies and a power source for selectively supplying the same with power.

* * * * *